US007083249B2

(12) United States Patent
Iwao

(10) Patent No.: US 7,083,249 B2
(45) Date of Patent: Aug. 1, 2006

(54) METHOD FOR ESTABLISHING STANDARD VALUES TO OBSCURE BANDING IN PRINTED RESULT OF INK JET PRINTER AND INK JET PRINTER SET UP BY THE SAME

(75) Inventor: Naoto Iwao, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 603 days.

(21) Appl. No.: 09/962,270

(22) Filed: Sep. 26, 2001

(65) Prior Publication Data

US 2002/0041298 A1 Apr. 11, 2002

(30) Foreign Application Priority Data

Sep. 29, 2000 (JP) ..... 2000-297882
Sep. 20, 2001 (JP) ..... 2001-286601

(51) Int. Cl.
*B41J 29/393* (2006.01)
*B41J 29/38* (2006.01)
*B41J 2/165* (2006.01)
*B41J 23/00* (2006.01)

(52) U.S. Cl. ..... 347/19; 347/9; 347/12; 347/14; 347/37

(58) Field of Classification Search ..... 347/9, 347/16, 19, 43, 37; 400/74, 279; 29/890.1
See application file for complete search history.

(56) References Cited

U.S. PATENT DOCUMENTS 4,328,504 A * 5/1982 Weber et al. ..... 347/19
4,626,867 A * 12/1986 Furukawa et al. ..... 347/19
4,675,696 A * 6/1987 Suzuki ..... 347/19
4,907,013 A * 3/1990 Hubbard et al. ..... 347/19
5,128,691 A * 7/1992 Millet et al. ..... 347/19
5,198,054 A * 3/1993 Drake et al. ..... 347/42
5,451,990 A * 9/1995 Sorenson et al. ..... 347/37
5,477,244 A * 12/1995 Shibata et al. ..... 347/19
5,568,172 A * 10/1996 Cowger ..... 347/19
5,825,378 A * 10/1998 Beauchamp ..... 347/19
5,835,108 A * 11/1998 Beauchamp et al. ..... 347/19
5,889,534 A * 3/1999 Johnson et al. ..... 347/19
6,036,297 A * 3/2000 Hayasaki ..... 347/13
6,049,348 A * 4/2000 Spurr ..... 347/234
6,109,716 A * 8/2000 Takahashi ..... 347/11
6,174,044 B1 * 1/2001 Yun ..... 347/40
6,196,736 B1 * 3/2001 Otsuki et al. ..... 400/124.01
6,290,319 B1 * 9/2001 Boleda et al. ..... 347/19
6,336,701 B1 * 1/2002 Hickman ..... 347/37

* cited by examiner

*Primary Examiner*—Thinh Nguyen
(74) *Attorney, Agent, or Firm*—Oliff & Berridge, PLC

(57) ABSTRACT

The invention relates to a method for setting a tolerance of each standard value, which is a factor in determination of ink droplets landing accuracy, to an ink jet printer that is set up using the method, by implementing a sensory test using printed results of an ink jet printer. With the tolerances set by the method, banding can be effectively obscured without significantly improving the mechanical precision of the ink jet printer. Particularly, when A1 is a deviation of a sheet feeding amount in the sub-scanning direction obtained by a dot line length of an average value of the sheet feeding amount in the sub-scanning direction from an ideal value, B1 is a maximum value of a deviation in the sub-scanning direction between the same color dots, and C1 is a maximum value of a deviation in the main scanning direction between the same color dots, it is set such that a value of tolerances of A1, B1, and C1 is A1≦B1≦C1.

25 Claims, 11 Drawing Sheets

FIG. 3

EVALUATION RESULT OF INK DROPLETS LANDING ACCURACY
IN SUB SCANNING DIRECTION BETWEEN SAME COLOR DOTS

| DIFFERENCE OF DOT LINE LENGTH Da [μm] | 0 | | | | | 5 | | | | | 10 | | | | | 20 | | | | |
|---|---|---|---|---|---|---|---|---|---|---|---|---|---|---|---|---|---|---|---|---|
| DEVIATION IN SUB SCANNING DIRECTION [μm] | ±0 | ±5 | ±10 | ±15 | ±20 | ±0 | ±5 | ±10 | ±15 | ±20 | ±0 | ±5 | ±10 | ±15 | ±20 | ±0 | ±5 | ±10 | ±15 | ±20 |
| T1 | ◎ | △ | × | × | × | △ | ◎ | × | × | × | △ | △ | × | × | × | △ | × | × | × | × |
| T2 | ◎ | △ | × | × | × | △ | △ | × | × | × | × | × | × | × | × | × | × | × | × | × |
| T3 | ◎ | △ | △ | × | × | △ | △ | × | × | × | △ | × | × | × | × | × | × | × | × | × |
| T4 | ◎ | △ | × | × | × | ◎ | ◎ | × | × | × | × | × | × | × | × | × | × | × | × | × |

FIG. 4

EVALUATION RESULT OF SHEET FEEDING ACCURACY

| SPACE DEVIATION A1,A2 [μm] | 0 | | | | | 5 | | | | | 10 | | | | |
|---|---|---|---|---|---|---|---|---|---|---|---|---|---|---|---|
| SPACE VARIATION [μm] | ±0 | ±5 | ±10 | ±15 | ±20 | ±0 | ±5 | ±10 | ±15 | ±20 | ±0 | ±5 | ±10 | ±15 | ±20 |
| T1 | ○ | △ | × | × | × | △ | × | × | △ | × | × | × | × | × | × |
| T2 | ○ | △ | × | × | × | × | × | × | × | × | × | × | × | × | × |
| T3 | ○ | △ | △ | × | × | × | × | × | × | × | × | × | × | × | × |
| T4 | ○ | △ | × | × | × | × | × | × | × | × | × | × | × | × | × |

FIG. 5

EVALUATION RESULT OF INK DROPLETS LANDING ACCURACY
IN SUB SCANNING DIRECTION BETWEEN DIFFERENT COLOR DOTS

| AVERAGE OF DEVIATION IN SUB SCANNING DIRECTION [μm] | 0 | | | | | 5 | | | | | 10 | | | | | 20 | | | | |
|---|---|---|---|---|---|---|---|---|---|---|---|---|---|---|---|---|---|---|---|---|
| VARIATION IN SUB SCANNING DIRECTION Df [μm] | ±0 | ±5 | ±10 | ±15 | ±20 | ±0 | ±5 | ±10 | ±15 | ±20 | ±0 | ±5 | ±10 | ±15 | ±20 | ±0 | ±5 | ±10 | ±15 | ±20 |
| T1 | ◎ | ◎ | △ | × | × | ◎ | △ | △ | × | × | ◎ | △ | △ | △ | × | ◎ | △ | × | × | × |
| T2 | ◎ | ◎ | △ | △ | × | ◎ | △ | × | × | × | △ | × | × | × | × | △ | × | × | × | × |
| T3 | ◎ | ◎ | △ | × | × | ◎ | △ | × | × | × | △ | △ | △ | △ | × | △ | × | × | × | × |
| T4 | ◎ | ◎ | △ | × | × | ◎ | △ | × | × | × | ◎ | △ | △ | △ | × | △ | × | × | × | × |

FIG. 6

EVALUATION RESULT OF INK DROPLETS LANDING ACCURACY IN MAIN SCANNING DIRECTION BETWEEN DIFFERENT COLOR DOTS

| | INCLINATION OF DOT LINE Dd [μm] | | | | | VARIATION OF DOT LANDING POSITION IN MAIN SCANNING DIRECTION [μm] | | | | |
|---|---|---|---|---|---|---|---|---|---|---|
| | 0 | 5 | 10 | 15 | 20 | ±0 | ±5 | ±10 | ±15 | ±20 |
| T1 | ○ | ○ | ○ | △ | × | ○ | ○ | ○ | △ | △ |
| T2 | ○ | ○ | △ | × | × | ○ | ○ | ○ | ○ | △ |
| T3 | ○ | ○ | × | × | × | ○ | ○ | △ | × | × |
| T4 | ○ | ○ | ○ | △ | △ | ○ | ○ | ○ | △ | △ |

METHOD FOR ESTABLISHING STANDARD VALUES TO OBSCURE BANDING IN PRINTED RESULT OF INK JET PRINTER AND INK JET PRINTER SET UP BY THE SAME

BACKGROUND OF THE INVENTION

1. Field of Invention

The invention relates to a method for setting a standard value by which banding is effectively obscured without significantly improving the mechanical precision of an ink jet printer and to an ink jet printer that is set up using the method.

2. Description of Related Art

Conventionally, there exist ink jet printers that form images on a recording medium using ink. In such ink jet printers, small dots are formed on the recording medium by selectively ejecting a small quantity of ink from a plurality of nozzles provided in an ink jet head, thereby forming the images on the recording medium. In such ink jet printers, the dots are formed on the recording medium, placed at a predetermined distance away from the nozzles, by ejecting ink droplets from the nozzles. Therefore, the dots tend to be displaced on the recording medium. More specifically, the ink droplets are not always ejected in a proper direction and at a right moment. Such displacements cause streaks, such as bands of discrete color or tone, in the images formed on the recording medium. The streaks, more particularly, unevenness in a sub-scanning direction produced by streaks extending in a main scanning direction, that is, banding, is one of big factors that leads to degraded images formed by the ink jet printer. It is considered that the elimination of banding is one of the most important requirements for securing high-quality images to be formed by the ink jet printer.

It is conceivable that position error of the nozzles provided in the ink jet head, a deviation of an ejecting direction of ink droplets from the nozzles, variations in an ink droplets ejecting speed, and a deviation of an average value of an amount of sheet feeding from an ideal value will cause the streaks. In order to obscure the banding produced by such causes, it is sufficient to improve the precision of the nozzles and the sheet feeding mechanism. However, in order to completely eliminate the banding, the nozzles and the sheet feeding mechanism have to be structured with extremely high precision, thereby significantly increasing the cost of the ink jet printer.

SUMMARY OF THE INVENTION

In the invention, the causes of the displacement of dots are identified with two types, and a tolerance of each ink droplet's landing accuracy is obtained according to ease of conspicuousness of banding ascribable to each type. One cause of the dot displacement is ink droplets landing accuracy traceable to each nozzle in an ink jet head. Another is ink droplets landing accuracy traceable to a sheet feeding mechanism. By obtaining the tolerance of the ink droplets landing accuracy, a condition for effectively obscuring the banding can be determined without significantly improving the mechanical precision of all mechanisms.

An ink jet printer of the invention performs printing on a recording medium using an ink jet head by relatively moving the printing medium and the ink jet head. In the ink jet printer, when a recording medium moving direction is referred to as a sub-scanning direction and a direction perpendicular to the sub-scanning direction is referred to as a main scanning direction, tolerances of the factors in determination of the ink droplets landing accuracy are set to $A1 \leqq B1$ and $A1 \leqq C1$, preferably $A1 \leqq B1 \leqq C1$, wherein A1 is a deviation of a sheet feeding amount in the sub-scanning direction obtained by a dot line length of an average value of the sheet feeding amount in the sub-scanning direction from an ideal value, B1 is a maximum value of a deviation in the sub-scanning direction between the same color dots, and C1 is a maximum value of a deviation in the main scanning direction between the same color dots.

Another ink jet printer of the invention performs printing on a recording medium using an ink jet head by relatively moving the printing medium and the ink jet head. In such an ink jet printer, when a recording medium moving direction is referred to as a sub-scanning direction and a direction perpendicular to the sub-scanning direction is referred to as a main scanning direction, tolerances of the factors in determination of the ink droplet's landing accuracy are set to preferably $A2 \leqq B2 \leqq C2 \leqq D2 \leqq E2 \leqq F2 \leqq G2$, wherein A2 is a deviation of a sheet feeding amount in the sub-scanning direction obtained by a dot line length of an average of the sheet feeding amount in the sub-scanning direction from an ideal value, B2 is a difference of a length between the two different color dot lines, C2 is an average value of a deviation in the sub-scanning direction between different color dots relative to each other, D2 is a maximum value of a deviation in the sub-scanning direction between the same color dots, E2 is an inclination of a dot line toward the main scanning direction against a different color dot line, F2 is an average value of a deviation in the main scanning direction each between the different color dots, and G2 is a maximum value of a deviation in the main scanning direction between the same color dots.

BRIEF DESCRIPTION OF THE DRAWINGS

An embodiment of the invention will be described in detail with reference to the following figures wherein:

FIG. 3 is an explanatory diagram showing the results of a first sensory test of the invention;

FIG. 4 is an explanatory diagram showing the results of a second sensory test of the invention;

FIG. 5 is an explanatory diagram showing the results of a third sensory test of the invention;

FIG. 6 is an explanatory diagram showing the results of a fourth sensory test of the invention;

DETAILED DESCRIPTION OF THE EMBODIMENTS

Figure 1:
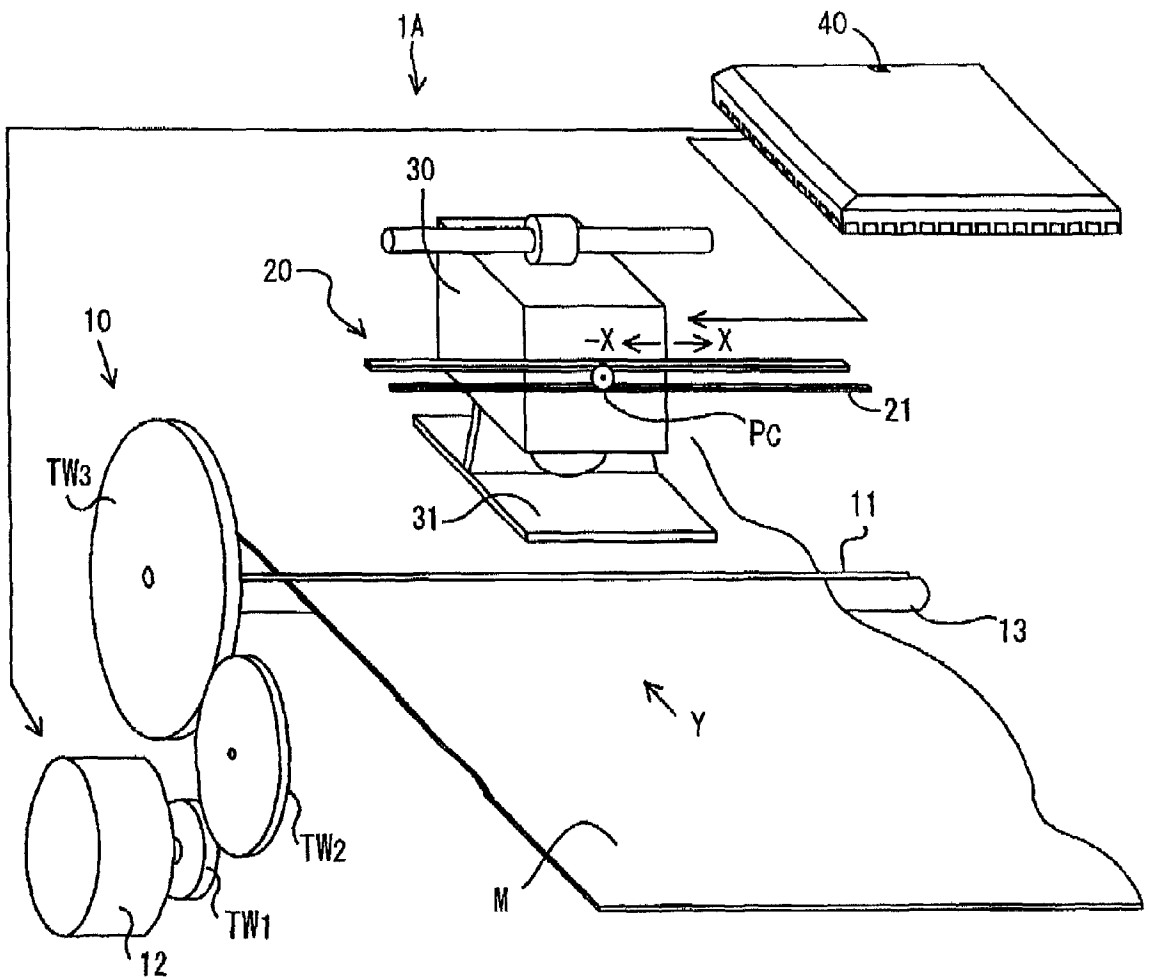
FIG. 1 is a perspective view showing a schematic structure of an ink jet printer of the invention.

The invention will be described with reference to the accompanying drawings. An ink jet printer 1A to which the invention is applied has a generally known structure. As shown in FIG. 1, the ink jet printer 1A includes a sheet feeding mechanism 10, a printing mechanism 20, and a controller 40. The sheet feeding mechanism 10 includes a sheet holder 11, a sheet feeding motor 12, gears TW1, TW2, TW3, and a sheet feeding shaft 13, to feed a sheet M in a y-axis direction (sub-scanning direction). The printing mechanism 20 includes a carriage belt 21, an ink tank 30, an ink jet head 31, and a pulley Pc, and is structured to move the ink jet head 31 in an x-axis direction (main scanning direction). At that time, printing is performed by which the controller 40 controls the ink jet head 31 to selectively eject ink droplets onto the sheet M.

In order to investigate the relationship between an occurrence of banding in the ink jet printer 1A and various parameters, a sensory test (also called sensory evaluation or sensory inspection) was implemented by four examinees. The sensory test is a test in which quality characteristics are evaluated using a human sense and the evaluation results and criteria are compared therebetween. In the sensory test, each examinee observes, and compares, applicable standard samples and test samples, in which dots are intentionally deviated, to determine an unacceptable level of the test samples.

In the samples used in the sensory test, ink dots, formed by ejecting ink droplets from the ink jet head 31 onto a recording medium, are enlarged so as to be easily observed. Specifically, a plurality of the samples, in which dots are intentionally deviated by gradually changing various parameters, are prepared. The deviation of dots (ink droplets landing accuracy) is traceable to the ink jet head 31.

Figure 2:
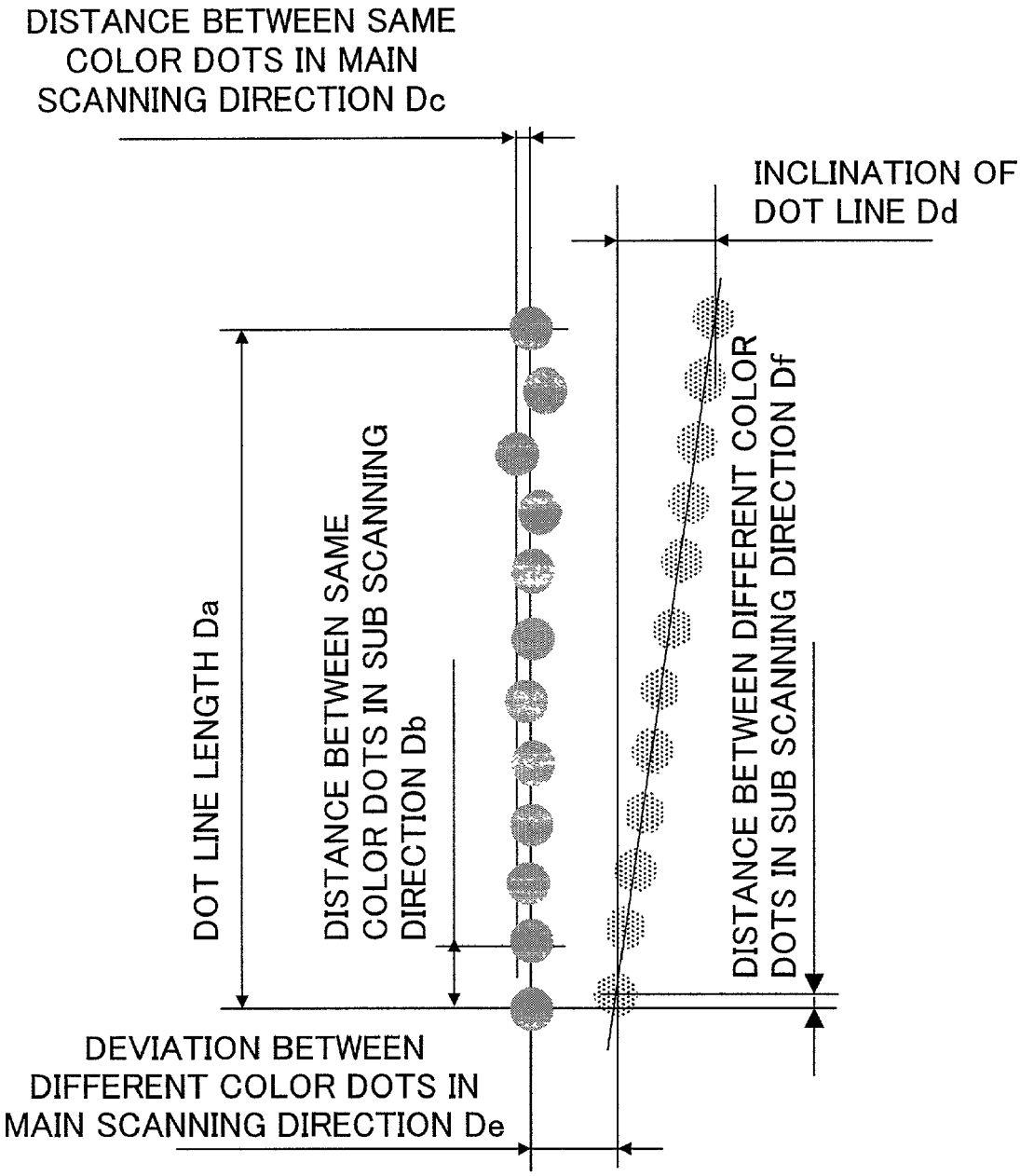
FIG. 2 is an explanatory diagram showing a test sample for a sensory test in the invention.

An example of the test sample is shown in FIG. 2. FIG. 2 shows a test sample in which dots are intentionally deviated. For a standard sample, an ideal sample, in which ink droplets are precisely landed on a recording medium at a design value, is prepared. The four examinees T1 to T4 visually compared the test sample with the standard sample, while the samples were placed in a line.

The example of the test sample shown in FIG. 2 will be described below. In the test sample, two dot lines are formed on a recording medium by ejecting ink droplets once from each of the nozzles, the nozzles arranged in two nozzle lines. In FIG. 2, as described above, the x-axis direction and the y-axis direction are the main scanning direction and the sub-scanning direction, respectively. Each nozzle line ejects a different color of ink.

A dot line length Da is a distance between dots at both ends in the sub-scanning direction in the same color dot line formed by a one-time ink ejection. In FIG. 2, while a length of a left dot line is specified as the dot line length Da, other dot lines are also specified as the same. A distance between same color dots in the sub-scanning direction Db is a distance each between the adjacent dots in the same color dot line in the sub-scanning direction. In FIG. 2, a distance between the two lowermost dots in the left dot line in the sub-scanning direction is specified as the distance Db. However, the distance Db is not restricted to the distance between the described two dots. A distance between same color dots in the main scanning direction Dc is an amount of deviation in the main scanning direction of dots from perfect alignment in the same color dot line. In FIG. 2, while a distance between an upper most dot and a third dot from the top in the left dot line in the main scanning direction is specified as the distance Dc, it is not restricted to the two dots. A dot line inclination Dd is an amount of inclination toward the main scanning direction of a same color dot line supposed to be aligned parallel to the sub-scanning direction. In FIG. 2, the amount of inclination toward the main scanning direction of the dot line, that is, in the figure, the right dot line is specified as the dot line inclination Dd. However, another dot line could also be specified for showing the inclination.

A variation (distance) between different color dots in the main scanning direction De is a distance each between different color dots relative to each other, in the main scanning direction. A distance between different color dots in the sub-scanning direction Df is a distance between different color dots relative to each other, in the sub-scanning direction. The different color dots relative to each other are dots having a different color which are ideally landed on a same position when an impure dot is formed.

In the sensory test, the test samples and the standard samples are magnified 25 times from the actual printed results for evaluation. Each examinee observes and compares the test samples with the standard samples, which are placed at a position 7.5 m away from the examinees (that is, an actual distance for observing the samples corresponds to 30 cm). The examinees evaluate each test sample and determine whether the sample has no visual problem (O), is acceptable (Δ), or is not acceptable (X).

However, each examinee has different dialectics and visual senses, so that the evaluation results vary from examiner to examiner. The results of the sensory tests are shown in FIGS. 3 to 6.

FIG. 3 shows the evaluation results for ink droplets landing accuracy in the sub-scanning direction in the same color dot line. With respect to each test sample with the dot line length Da (FIG. 2), in each of which a difference of the dot line length Da between a design value and a measured value is 0 μm, 5 μm, 10 μm, and 20 μm, dots are formed on the recording sheet while the distance between the same color dots in the sub-scanning direction Db (FIG. 2) is ±0 μm, ±5 μm, ±10 μm, ±15 μm and ±20 μm as compared with the standard sample. The sensory test was implemented by the examinees T1 to T4 using the above described test samples and the standard sample.

According to the evaluation result, when the difference of the dot line length Da between the design value and the measured value is 10 μm and 20 μm, no one of the examinees T1 to T4 determined that the test sample had no problem at any value of the distance between the same color dots in the sub-scanning direction Db. The examinees T1 to T4 determined that most test samples were not acceptable (X). When the difference of the dot line length Da between the design value and the measured value is 0 μm or 5 μm and the distance between the same color dots in the sub-scanning direction Db is ±0 μm or ±5 μm, the examinees T1 to T4 determined that the test sample is either no problem (O) or is acceptable (Δ).

As a result of this, it can be found that a tolerance for the difference of the same color dot line length Da between the design value and the measured value is 5 μm and a maximum tolerance of the distance between the same color dots in the sub-scanning direction Db is ±5 μm.

Accordingly, a tolerance for the ink droplets landing accuracy in the sub-scanning direction in the same color dot line is 10 μm, which is the sum of the tolerance of the difference of the same color dot line length Da between the design value and the measured value (5 μm) and the maximum tolerance of the distance between the same color dots in the sub-scanning direction Db (±5 μm). However, it can be analogized that the tolerance is preferably in the order of 8 μm from a visual standpoint.

FIG. 4 is an evaluation result of sheet feeding accuracy (in the sub-scanning direction). With respect to the test samples, each of which has a space deviation of 0 μm, 5 μm, or 10 μm, there are space variations for every sheet feeding of ±0 μm, ±5 μm, ±10 μm, ±15 μm and ±20 μm. The sensory test was implemented by the examinees T1 to T4 using the above described test samples and the standard sample. The space deviation is a difference in an amount of the sheet feeding in the sub-scanning direction between a design value β and an average value α. The space variations of every sheet feeding is a difference, caused by sheet feeding, between the design value and an actual amount of sheet feeding.

Figure 7A:
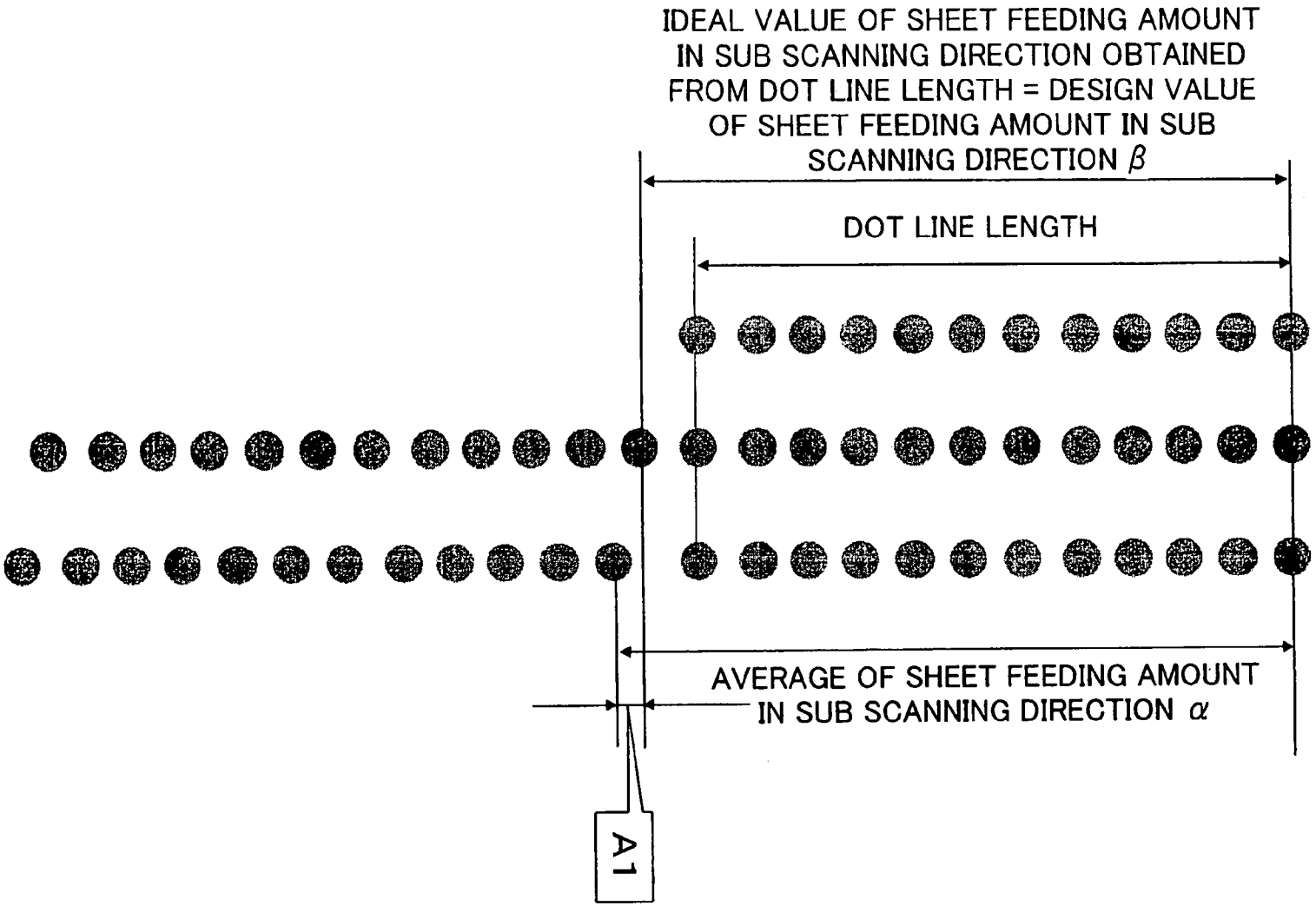
FIG. 7A shows details of the printing result of dots formed by nozzles ejecting a same color ink.

Referring now to FIG. 7A, in particular, the average value of the amount of sheet feeding in the sub-scanning direction is a distance shown by an arrow α and the design value (ideal value) of the amount of sheet feeding in the sub-scanning direction is a distance shown by an arrow β. Therefore, the amount of the space deviation, which is the difference in the amount of the sheet feeding between the design value and the average value, is a distance shown by an A1 (α−β=A1).

According to the evaluation results, when the space deviation A1 is 10 μm, all the examinees T1 to T4 determined that the test samples are not acceptable (X), regardless of the values of the space variations.

Only the examinee T1 determined that the test samples are acceptable (Δ) when the space deviation is 5 μm and the space variations are ±0 μm and when the space deviation is 5 μm and the space variations are ±15 μm.

On the other hand, when the space deviation A1 is 0 μm and the space variations of every sheet feeding is ±0 μm, the examinees T1 to T4 determined that the test sample had no problem (O), and when the space deviation A1 is 0 μm and the space variations are ±5 μm, the examinees T1 to T4 determined that the test sample was acceptable (Δ). However, it is impossible that the space deviation A1, which is the difference of the amount of the sheet feeding in the sub-scanning direction between the average value α and the design value β, is 0 μm because of design. As noted above, only one person, the examinee T1, determined that two test samples are acceptable (Δ) when the space deviation A1 is 5 μm and the space variation is ±0 μm and ±15 μm.

Therefore, according to the evaluation result, it can be determined that a tolerance of the space deviation A1 is between or equal to 0 μm and 5 μm. It can be analogized that a preferred tolerance is of the order of 3 μm. Further, a maximum tolerance of the space variations is between or equal to ±5 μm and ±10 μm, that is, 10 μm and 20 μm. Accordingly, it can be analogized that a preferred maximum variations are on the order of 15 μm.

FIG. 5 is the evaluation results of ink droplets landing accuracy between different color dots relative to each other in the sub-scanning direction. There are test samples in each of which a difference between an average value (see C2 in FIG. 8C) and a design value of the deviation between two different color dots relative to each other, in the sub-scanning direction, is 0 μm, 5 μm, 10 μm, and 20 μm. With respect to those test samples, each includes variations (distance Df: see FIG. 2) between the different color dots relative to each other, in the sub-scanning direction, of ±0 μm, ±5 μm, ±10 μm, ±15 μm, and ±20 μm. The sensory test was implemented by the examinees using the test and the standard sample. Particularly, when an impure dot is formed by two different colors of ink, it is the goal the ink droplets ejected from one nozzle line land at the same position as ink droplets ejected from another nozzle line. However, ink droplets ejected from the nozzles, relative to each other, in the different nozzle lines, that is, different color dots relative to each other, do not always land on the same position because of a lack of mechanical precision. Therefore, the ink droplets landing accuracy of different color dots relative to each other in the sub-scanning direction (FIG. 5) and in the main scanning direction (FIG. 6) is also evaluated.

According to the evaluation result, when the variations, between the different color dots, in the sub-scanning direction (the distance Df) is ±0 μm, ±5 μm, and ±10 μm, the examinees T1 to T4 determined that the most of the test samples either have no problem (O) or were acceptable (Δ). When the variations, between the different color dots, in the sub-scanning direction (the distance Df) is ±15 μm, the examinees T1 to T4 determined that most test samples were not acceptable (X). When the variations, between the different color dots, in the sub-scanning direction (the distance Df) is ±20 μm, all the examinees T1 to T4 determined that the test sample was not acceptable (X). Thus, a maximum tolerance of the variations, between the different color dots, in the sub-scanning direction (the distance Df) is between or equal to ±5 μm and ±10 μm.

When the difference between the average value (see C2 in FIG. 8C) and the design value of the amount of the deviation in the sub-scanning direction between the different dots relative to each other is 0 μm, 5 μm, and 10 μm, the examinees T1 to T4 determined that a number of the test samples either have no problem (O) or are acceptable (Δ). However, when the difference is 20 μm, the examinees T1 to T4 determined that the test samples are not acceptable (X) except when the variations is ±0 μm.

Accordingly, it can be found that a tolerance for the difference between the average value (see C2 in FIG. 8C) and the design value of the deviation between two different color dots relative to each other, in the sub-scanning direction, is 10 μm. As described above, the maximum tolerance of the variations, between the different color dots, in the sub-scanning direction (the distance Df), is between or equal to ±5 μm and ±10 μm, that is, 10 μm and 20 μm. Therefore, it can be analogized that a preferred maximum tolerance is of the order of 15 μm. Further, as described above, the tolerance of the deviation from the average value between the same color dots in the sub-scanning direction is of the order of 5 μm.

FIG. 6 is an evaluation result of ink droplets landing accuracy between the different color dots relative to each other in the main scanning direction. Here, with respect to the test samples with the amount of inclination of the dot line, as shown in FIG. 2, that is, the amount of deviation toward the main scanning direction of the same color dot line Dd of 0 μm, 5 μm, 10 μm, 15 μm, and 20 μm, the variation each between the different color dots relative to each other in the main scanning direction is ±0 μm, ±5 μm, ±10 μm, ±15 μm, and ±20 μm. The sensory test was implemented by the examinees T1 to T4 using the above-described test samples and the standard sample.

According to the evaluation result, when the amount of inclination of the dot line is 10 μm, two of four examinees determined that the test sample has no problem (O), one examinee determined that it is acceptable (Δ), and another examinee determined that it is not acceptable (X). When the amount of the inclination is 15 μm, two examinees determined that the test sample is acceptable (Δ), and other two examinees determined that it is not acceptable (X). As a result, it can be determined that a tolerance of the amount of the inclination of the dot line is of the order of 10 μm.

When the amount of deviation toward the main scanning direction between the different color dots relative to each other is ±0 μm, ±5 μm, and ±10 μm, the examinees T1 to T4 determined that the most of the test samples either have no problem (O) or are acceptable (Δ). On the other hand, when the variation is ±15 μm and ±20 μm, the examinees T1 to T4 primarily determined that the test samples are either acceptable (Δ) or not acceptable (X). As a result, it can be determined that a maximum tolerance of the variation in the main scanning direction each between the different color dots is ±10 μm.

Therefore, a tolerance of the amount of the inclination of the dot line is of the order of 10 μm, and a maximum tolerance of the variation in the main scanning direction between the different color dots is ±10 μm. Accordingly, the variation in the main scanning direction between the different color dots is 20 μm (10 μm+10 μm=20 μm). Further, the average value of the deviation in the main scanning direction is 20 μm because the maximum tolerance is ±10 μm. It is preferably 10 μm, and further preferably of the order of 8 μm.

A table below provides a summary of the results described above.

TABLE 1

| | | | |
|---|---|---|---|
| Ink droplets landing accuracy between same color dots | Deviation in main scanning direction | Maximum | 20 μm (C1, G2) |
| | Deviation in sub-scanning direction | Maximum | 8 μm (B1, D2) |
| Ink droplets landing accuracy between different color dots | Deviation in main scanning direction | Average | 20 μm (F2) |
| | | Maximum | 20 μm |
| | Deviation in sub-scanning direction | Average | 5 μm (C2) |
| | | Maximum | 15 μm |
| | Difference of dot line length | | 5 μm (B2) |
| | Inclination of dot line in main scanning direction | | 10 μm (E2) |
| Sheet feeding accuracy in sub-scanning direction | Deviation of average value from ideal value | Average | 3 μm (A1, A2) |
| | | Variation | 15 μm |

Figure 7B:
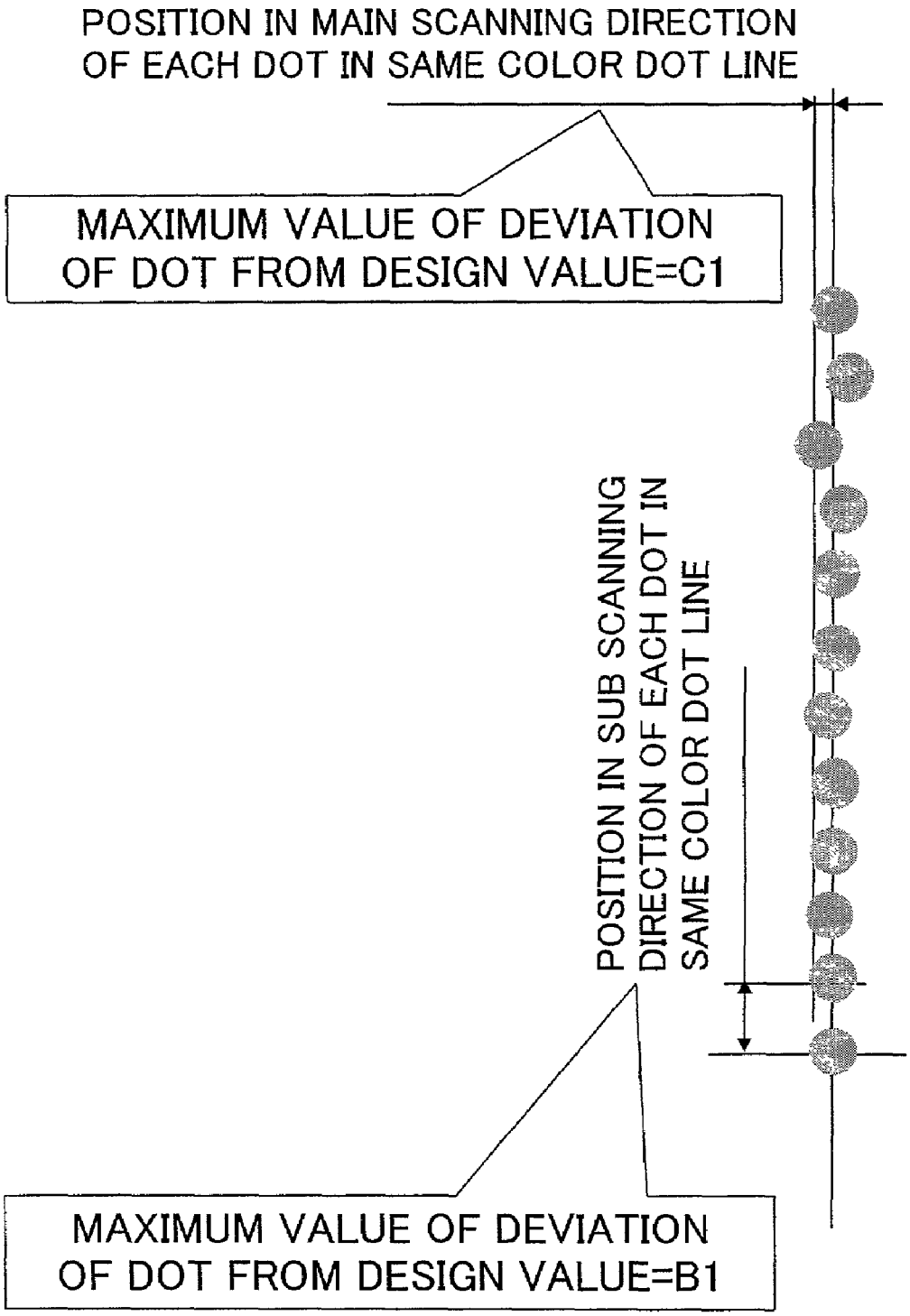
FIG. 7B shows details of each deviation in the printing result of dots formed by nozzles ejecting a same color ink.

Referring now to FIGS. 7A and 7B, the setting of a nozzle line for one color ink will be described below. In FIG. 7A, a left dot line of three dot lines is formed by ejecting ink droplets once from the nozzle line onto a recording medium. A middle dot line of the three dot lines is formed by ejecting ink droplets once from the nozzle line onto the recording medium and then ejecting ink droplets once again after the recording medium is forwarded by an ideal amount (design value) in the sub-scanning direction. The right hand dot line of the three dot lines is formed by ejecting ink droplets once from the nozzle line onto the recording medium and then ejecting ink droplets once again after the recording medium is forwarded by an average amount of the sheet feeding amount in the sub-scanning direction. In FIG. 7B, a dot line is formed by ejecting ink droplets once from the nozzle line onto the recording medium.

As shown in FIGS. 7A and 7B, with respect to the same color dot line, that is, the dot line formed by the nozzle line for ejecting one color ink droplets, when A1 is a deviation of a sheet feeding amount in the sub-scanning direction obtained by a dot line length of an average of the sheet feeding amount in the sub-scanning direction, from an ideal value, B1 is a maximum value of a deviation in the sub-scanning direction between the same color dots, and C1 is a maximum value of a deviation in the main scanning direction between the same color dots, it can be seen from the Table 1 that A1 is 3 μm, B1 is 8 μm, and C1 is 20 μm. Accordingly, it is recommended that a tolerance of A1, B1, and C1 is set to A1≦B1 or A1≦C1, preferably A1≦B1≦C1.

Figure 8A:
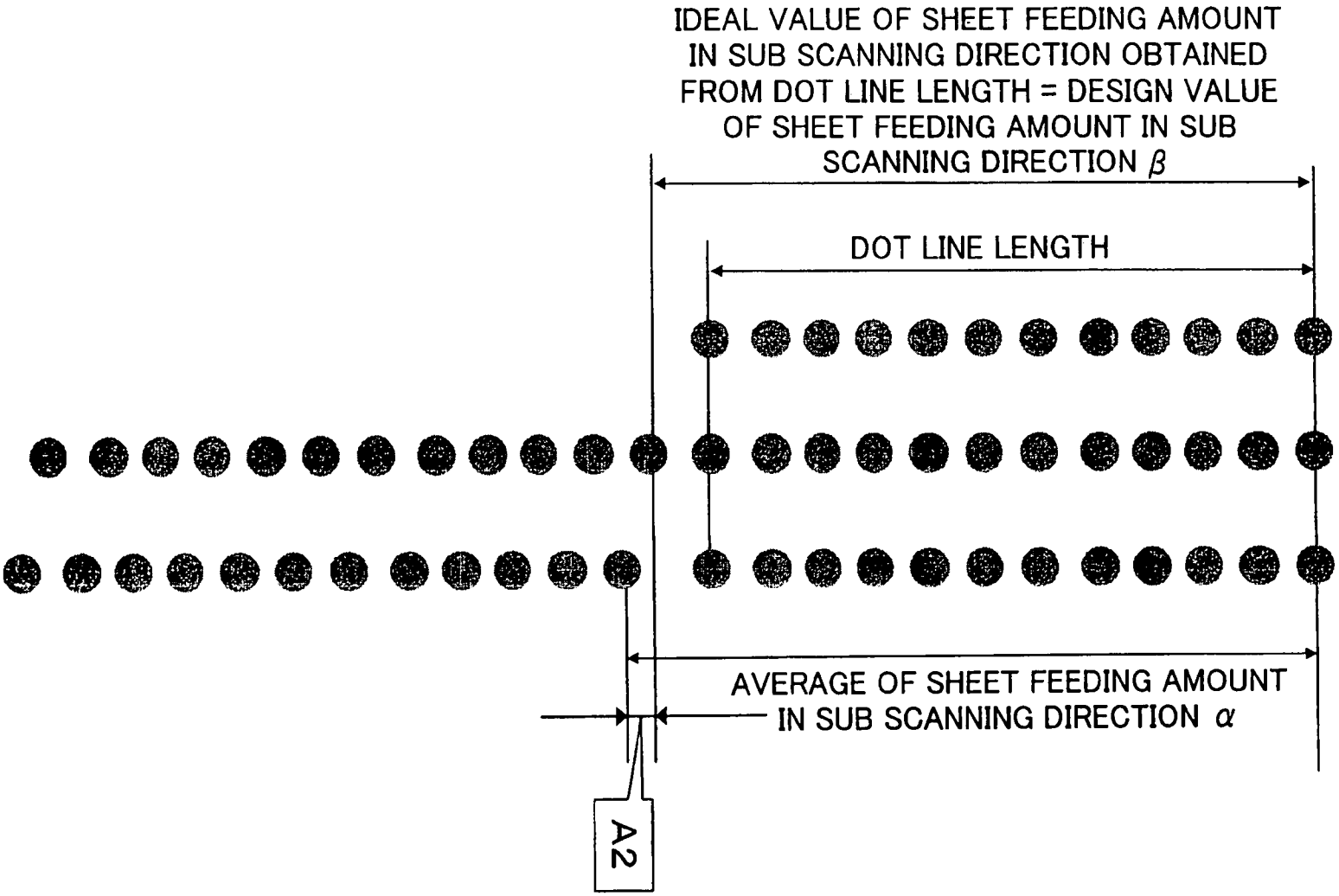
FIG. 8A shows details of a printing result of dots formed by nozzles ejecting a same color ink.

Next, referring to FIGS. 8A–8C, a setting of two nozzle lines, each ejecting a different color, will be described. In FIG. 8A, a left dot line of three dot lines is formed on a recording medium by ejecting ink droplets once from one of the nozzle lines. A middle dot line of the three dot lines is formed by ejecting ink droplets once from one of the nozzle lines onto the recording medium and then ejecting ink droplets once again after the recording medium is forwarded by an ideal value (design value) in the sub-scanning direction. A right dot line of the three dot lines is formed by ejecting ink droplets once from the nozzle line on the recording medium and then ejecting ink droplets once again after the recording medium is forwarded by an average value of the sheet feeding amount in the sub-scanning direction.

Figure 8B:
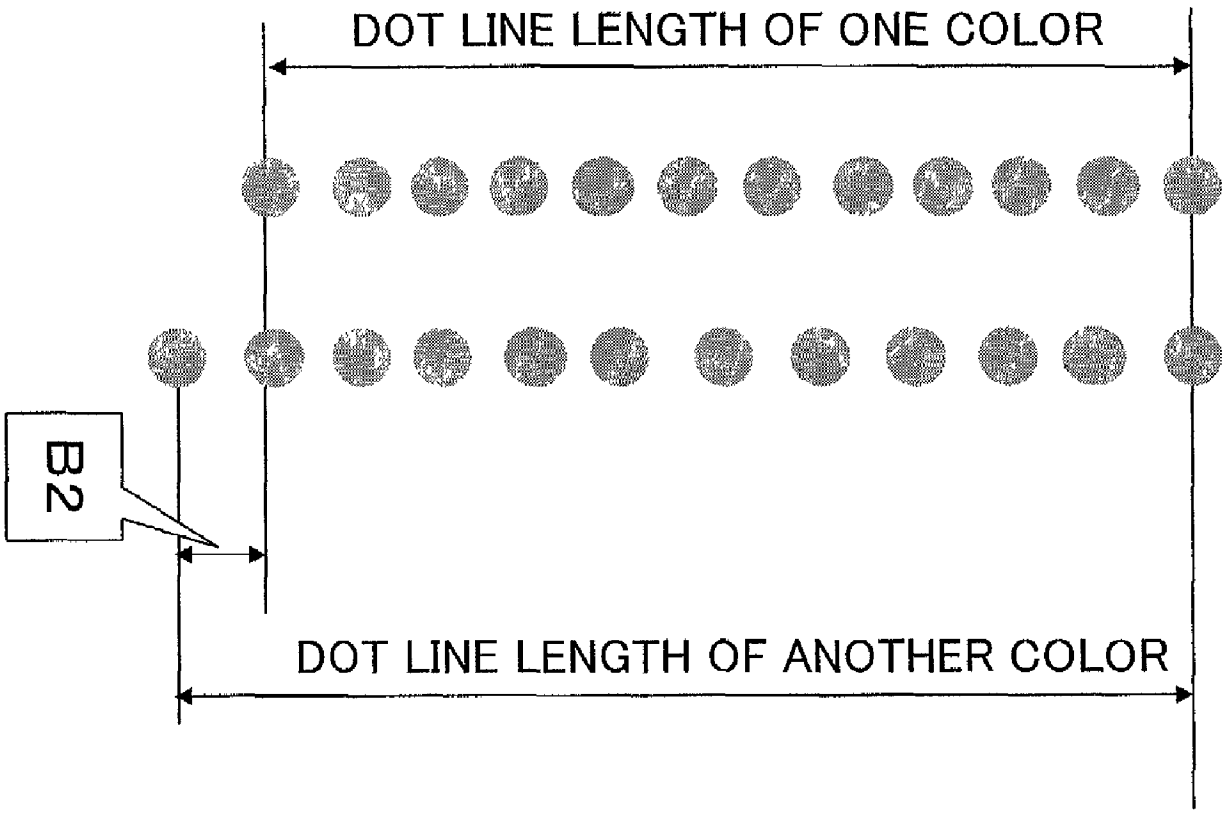
FIG. 8B shows details of a deviation of a dot line length in the printing result of dots formed by nozzles ejecting a different color ink.
Figure 8C:
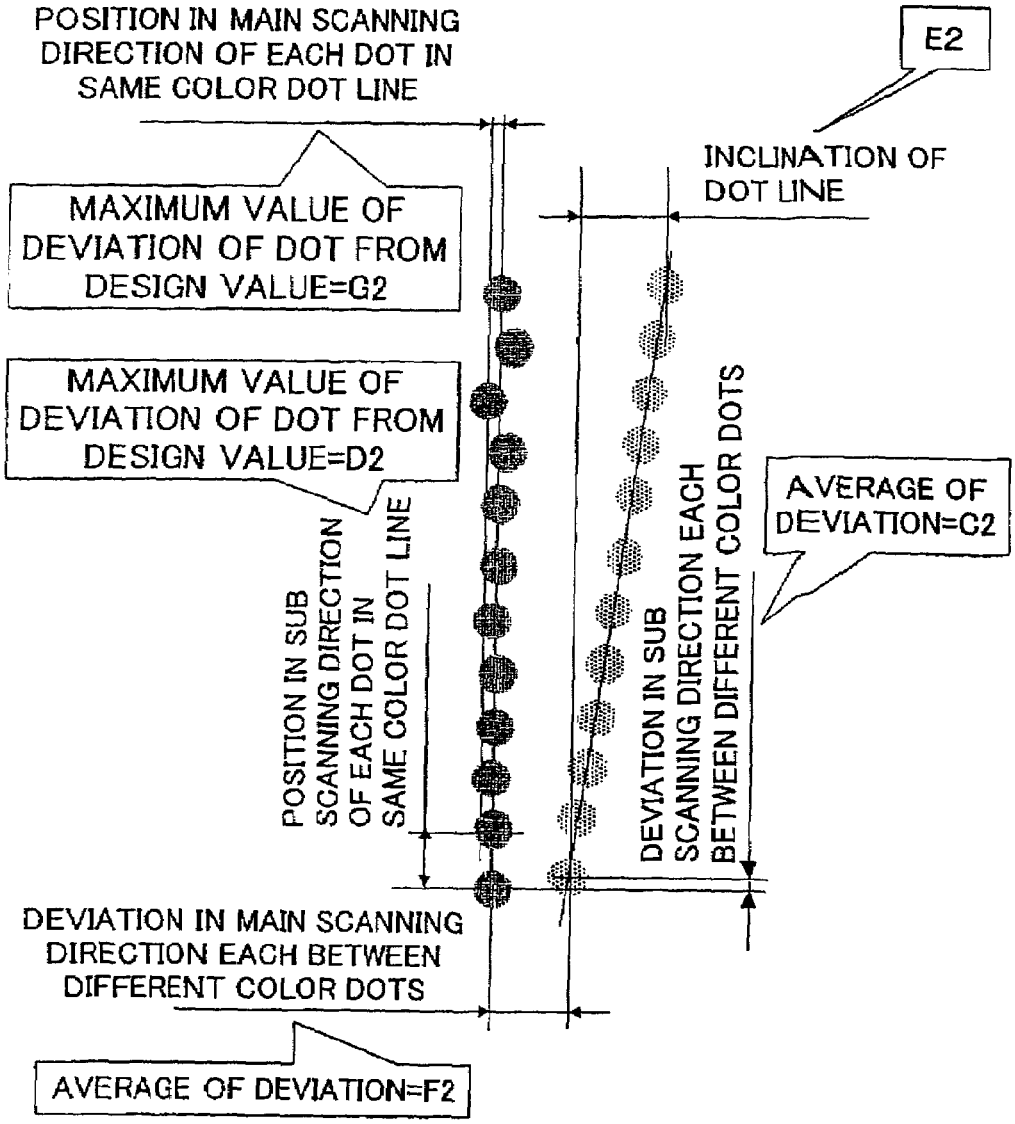
FIG. 8C shows details of each deviation in a printing result of dots formed by nozzles ejecting a different color ink.

In FIGS. 8B and 8C, two different color dot lines are formed by ejecting ink droplets once from the two nozzle lines onto the recording medium.

As shown in FIGS. 8A to 8C, when A2 is a deviation of a sheet feeding amount in the sub-scanning direction obtained by a dot line length of an average of the sheet feeding amount in the sub-scanning direction, from an ideal value, B2 is a difference in a length between the two different color dot lines, C2 is an average value of a deviation in the sub-scanning direction between different color dots relative to each other, D2 is a maximum value of a deviation in the sub-scanning direction between the same color dots, E2 is an inclination of a dot line toward the main scanning direction against a different color dot line, F2 is an average value of a deviation in the main scanning direction each between the different color dots, and G2 is a maximum value of a deviation in the main scanning direction between the same color dots, it can be seen from Table 1 that A2 is 3 μm, B2 is 5 μm, C2 is 5 μm, D2 is 8 μm, E2 is 10 μm, F2 is 20 μm, and G2 is 20 μm. Therefore, it is found that a tolerance of A2, B2, and C2 is set to A2≦B2 or A2≦C2, preferably, A2≦B2≦C2. Further, a tolerance of B2, C2, and D2 is set to B2≦D2 or C2≦D2, preferably, B2≦C2≦D2. Furthermore, a tolerance of D2, E2, F2, and G2 is set to D2≦E2, D2≦F2, or D2≦G2, preferably, D2≦E2≦F2≦G2. In summary, it is found that a tolerance of A2, B2, C2, D2, E2, F2, and G2 is preferably set to A2≦B2≦C2≦D2≦E2≦F2≦G2. Further, it can be found that mechanical precision is adjusted so that the tolerance of A2 to G2 is equal to or less than 20 μm.

The relationship among a parameter of ink droplets landing accuracy, design specifications, and a parameter for controlling design specifications when an ink jet head is a piezoelectric type, is shown in the table below.

TABLE 2

| Parameter of ink droplets landing accuracy | Design specifications | Parameter for controlling design specifications |
|---|---|---|
| Deviation in main scanning direction | Position of nozzle hole | Nozzle fabricating accuracy<br>Head assembling accuracy |
| | Ink droplet ejecting direction | Ink-repellent coating<br>Nozzle hole shape |
| | Ink droplet ejecting speed | Shape of applied pulses |
| Inclination in main scanning direction | Position of nozzle hole | Nozzle fabricating accuracy<br>Head assembling accuracy |
| Deviation in sub-scanning direction | Position of nozzle hole | Nozzle fabricating accuracy<br>Head assembling accuracy |
| | Ink droplet ejecting direction | Ink-repellent coating<br>Nozzle hole shape<br>Head mounting accuracy |

TABLE 2-continued

| | | |
|---|---|---|
| Difference of dot line length | Position of nozzle hole | Nozzle fabricating accuracy |
| | | Head assembling accuracy |
| | Ink droplet ejecting direction | Ink-repellent coating |
| | | Nozzle hole shape |
| Sheet feeding accuracy in sub-scanning direction | Amount of sheet feeding | Sheet feeding mechanism parts |
| | | Fabricating accuracy |

It is apparent from Table 2 that the mechanical precision is adjusted so that at least one of specifications of the position of nozzle hole, the ink droplet ejecting direction, the ink droplet ejecting speed, and the amount of sheet feeding satisfies an inequality of A1 to C1 or A2 to G2 or the conditions shown in the Table 1.

In the invention, the permissible deviation of ink droplets landing when ink droplets ejected from the nozzles are ejected onto the recording medium, that is, the tolerance of the ink droplets landing accuracy is such that the deviations of dots are difficult to discern by the human eye, is experimentally determined. Then, each parameter of the ink jet printer is set according to the tolerance, thereby banding can be effectively obscured without improving all aspects of mechanical precision.

While the invention has been described in detail with reference to a specific embodiment thereof, it would be apparent to those skilled in the art that various changes and modifications may be made therein without departing from the spirit of the invention.

The embodiment has been described with respect to a serial printer. However, the invention can be also applied to a line printer.

What is claimed is:

1. An ink jet printer, having a printing mechanism with a reciprocal carriage mounting an ink jet head and a sheet feeding mechanism, that performs printing on a recording medium using the ink jet head by moving the recording medium and the ink jet head relative to each other, wherein a recording medium moving direction is referred to as a sub-scanning direction and a direction perpendicular to the sub-scanning direction is referred to as a main scanning direction, comprising the ink jet printer having values of tolerances of A1, B1, and C1 that contribute to determination of ink droplets landing accuracy having relationships such that $A1 \leqq B1$ and $A1 \leqq C1$, where A1: a deviation of a sheet feeding amount in the sub-scanning direction obtained by a dot line length of an average value of the sheet feeding amount in the sub-scanning direction, from an ideal value;

B1: a maximum value of a deviation in the sub-scanning direction between same color dots; and C1: a maximum value of a deviation in the main scanning direction between the same color dots.

2. The ink jet printer according to claim 1, wherein the values of A1, B1, and C1 are set to $A1 \leqq B1 \leqq C1$.

3. The ink jet printer according to claim 1, wherein at least one of specifications including a nozzle hole position, an ink ejecting direction, an ink ejecting speed, and a sheet feeding amount, of the ink jet printer, can be adjusted to satisfy the condition indicated by a defined relationship of the values of tolerances.

4. The ink jet printer according to claim 3, wherein the ink jet printer is a serial printer that performs printing by moving the ink jet head in a main scanning direction.

5. The ink jet printer according to claim 3, wherein the ink jet printer is a line printer that performs printing of a length of the ink jet head at a time.

6. An ink jet printer, having a printing mechanism with a reciprocal carriage mounting an ink jet head and a sheet feeding mechanism, that performs printing on a recording medium using the ink jet head by moving the recording medium and the ink jet head relative to each other, wherein a recording medium moving direction is referred to as a sub-scanning direction and a direction perpendicular to the sub-scanning direction is referred to as a main scanning direction, comprising the ink jet printer having values of tolerances of A2, B2, C2, D2, E2, F2, and G2 that contribute to determination of ink droplets landing accuracy having relationships such that $A2 \leqq B2 \leqq C2 \leqq D2 \leqq E2 \leqq F2 \leqq G2$, where A2: a deviation of a sheet feeding amount in the sub-scanning direction obtained by a dot line length of an average of the sheet feeding amount in the sub-scanning direction, from an ideal value;

B2: a difference of a length between two different color dot lines;

C2: an average value of a deviation in the sub-scanning direction between different color dots relative to each other;

D2: a maximum value of a deviation in the sub-scanning direction between same color dots;

E2: an inclination of a dot line toward the main scanning direction against a different color dot line;

F2: an average value of a deviation in the main scanning direction between the different color dots; and G2: a maximum value of a deviation in the main scanning direction between the same color dots.

7. The ink jet printer according to claim 6, wherein at least one of specifications including a nozzle hole position, an ink ejecting direction, an ink ejecting speed, and a sheet feeding amount of the ink jet printer can be adjusted to satisfy the condition indicated by a defined relationship of the values of tolerances.

8. The ink jet printer according to claim 7, wherein the ink jet printer is a serial printer that performs printing by moving the ink jet head in a main scanning direction.

9. The ink jet printer according to claim 7, wherein the ink jet printer is a line printer that performs printing of a length of the ink jet head at a time.

10. An ink jet printer, having a printing mechanism with a reciprocal carriage mounting an ink jet head and a sheet feeding mechanism, that performs printing on a recording medium using the ink jet head by moving the recording medium and the ink jet head relative to each other, wherein a recording medium moving direction is referred to as a sub-scanning direction and a direction perpendicular to the sub-scanning direction is referred to as a main scanning direction, the ink jet printer having values of tolerances of A2, B2, C2, D2, E2, F2, and G2 that contribute to determination of ink droplets landing accuracy are 20 μm or smaller, where A2: a deviation of a sheet feeding amount in the sub-scanning direction obtained by a dot line length of an average of the sheet feeding amount in the sub-scanning direction, from an ideal value;

B2: a difference of a length between two different color dot lines;

C2: an average value of a deviation in the sub-scanning direction between different color dots relative to each other;

D2: a maximum value of a deviation in the sub-scanning direction between same color dots;

E2: an inclination of a dot line toward the main scanning direction against a different color dot line;

F2: an average value of a deviation in the main scanning direction between the different color dots; and G2: a maximum value of a deviation in the main scanning direction between the same color dots.

11. The ink jet printer according to claim 10, wherein at least one of specifications including a nozzle hole position, an ink ejecting direction, an ink ejecting speed, and a sheet feeding amount of the ink jet printer can be adjusted to satisfy the condition of the landing accuracy are 20 μm or smaller.

12. The ink jet printer according to claim 11, wherein the ink jet printer is a serial printer that performs printing by moving the ink jet head in a main scanning direction.

13. The ink jet printer according to claim 11, wherein the ink jet printer is a line printer that performs printing of a length of the ink jet head at a time.

14. An ink jet printer, having a printing mechanism with a reciprocal carriage mounting an ink jet head and a sheet feeding mechanism, that performs printing on a recording medium using the ink jet head by moving the recording medium and the ink jet head relative to each other, wherein a recording medium moving direction is referred to as a sub-scanning direction and a direction perpendicular to the sub-scanning direction is referred to as a main scanning direction, comprising the ink jet printer having values of tolerances of factors in determination of ink droplets landing accuracy set as described below:

| | | | |
|---|---|---|---|
| Ink droplets landing accuracy between same color dots | Deviation in main scanning direction | Maximum | 20 μm |
| | Deviation in sub-scanning direction | Maximum | 8 μm |
| Ink droplets landing accuracy between different color dots | Deviation in main scanning direction | Average | 20 μm |
| | | Maximum | 20 μm |
| | Deviation in sub-scanning direction | Average | 5 μm |
| | | Maximum | 15 μm |
| | Difference of dot line length | | 5 μm |
| | Inclination of dot line in main scanning direction | | 10 μm |
| Sheet feeding accuracy in sub scanning direction | Deviation of average value from ideal value | Average | 3 μm |
| | | Variation | 15 μm |

15. The ink jet printer according to claim 14, wherein at least one of specifications including a nozzle hole position, an ink ejecting direction, an ink ejecting speed, and a sheet feeding amount of the ink jet printer can be adjusted to satisfy the defined drop landing accuracy.

16. The ink jet printer according to claim 15, wherein the ink jet printer is a serial printer that performs printing by moving the ink jet head in a main scanning direction.

17. The ink jet printer according to claim 15, wherein the ink jet printer is a line printer that performs printing of a length of the ink jet head at a time.

18. A method for setting values of optical tolerances of standard values of A1, B1, and C1 that contribute to determination of ink droplets landing accuracy in an ink jet printer, having a printing mechanism with a reciprocal carriage mounting an ink jet head and a sheet feeding mechanism, by implementing a sensory test using a printed result, when a recording medium moving direction is referred to as a sub-scanning direction and a direction perpendicular to the sub-scanning direction is referred to as a main scanning direction, in the ink jet printer that performs printing on a recording medium using the ink jet head by moving the recording medium and the ink jet head relative to each other, comprising:

determining the optical tolerances of values A1, B1 of dot placement in the sub-scanning direction and of value C1 of dot placement in the main scanning direction relative to other dots; and adjusting the mechanical precision of at least one of a nozzle hole position, an ink ejecting direction, an ink ejection speed, and a sheet feeding amount to be within the optical tolerance, where A1: a deviation of a sheet feeding amount in the sub-scanning direction obtained by a dot line length of an average value of the sheet feeding amount in the sub-scanning direction, from an ideal value;

B1: a maximum value of a deviation in the sub-scanning direction between same color dots; and C1: a maximum value of a deviation in the main scanning direction between the same color dots.

19. A method for setting values of optical tolerances of standard values of A2, B2, C2, D2, E2, F2, and G2 that contribute to determination of ink droplets landing accuracy in an ink jet printer, having a printing mechanism with a reciprocal carriage mounting an ink jet head and a sheet feeding mechanism, by implementing a sensory test using a printed result, when a recording medium moving direction is referred to as a sub-scanning direction and a direction perpendicular to the sub-scanning direction is referred to as a main scanning direction, in an ink jet printer that performs printing on a recording medium using an ink jet head by moving the recording medium and the ink jet head relative to each other, comprising:

determining the optical tolerances of values of A2, B2, C2 and D2 dot placement in the sub-scanning direction and of values E2, F2, and G2 of dot placement in the main scanning direction relative to other dots; and adjusting the mechanical precision of at least one of a nozzle hole position, an ink ejecting direction, and ink ejection speed, and a sheet feeding amount to be within the optical tolerances, where:

A2: a deviation of a sheet feeding amount in the sub-scanning direction obtained by a dot line length of an average of the sheet feeding amount in the sub-scanning direction, from an ideal value;

B2: a difference of a length between two different color dot lines;

C2: an average value of a deviation in the sub-scanning direction between different color dots relative to each other;

D2: a maximum value of a deviation in the sub-scanning direction between same color dots;

E2: an inclination of a dot line toward the main scanning direction against a different color dot line;

F2: an average value of a deviation in the main scanning direction between the different color dots; and G2: a maximum value of a deviation in the main scanning direction between the same color dots.

20. A method of improving the appearance of print created by an ink jet printer, having a printing mechanism with a reciprocal carriage mounting an ink jet head and a sheet feeding mechanism, without improvement of precision in all mechanical relationships, comprising the steps of:

determining optical tolerances of dot placement in a sub-scanning and main scanning direction relative to other dots; and adjusting the mechanical precision of at least one of a nozzle hole position, an ink ejecting direction, an ink ejection speed, and a sheet feeding amount to be within the optical tolerances.

21. The method according to claim 20, wherein the optical tolerances determined include determining:

A1: a deviation of a sheet feeding amount in the sub-scanning direction obtained by a dot line length of an average value of the sheet feeding amount in the sub-scanning direction, from an ideal value;

B1: a maximum value of a deviation in the sub-scanning direction between same color dots; and C1: a maximum value of a deviation in the main scanning direction between the same color dots; and further comprising the step of setting a precision to establish a tolerance relationship where A1≦B1 and A1≦C1.

22. The method according to claim 21, wherein the tolerance relationship is set to A1≦B1≦C1.

23. The method according to claim 20, wherein the optical tolerances determined include determining:

A2: a deviation of a sheet feeding amount in the sub-scanning direction obtained by a dot line length of an average of the sheet feeding amount in the sub-scanning direction, from an ideal value;

B2: a difference of a length between two different color dot lines;

C2: an average value of a deviation in the sub-scanning direction between different color dots relative to each other;

D2: a maximum value of a deviation in the sub-scanning direction between same color dots;

E2: an inclination of a dot line toward the main scanning direction against a different color dot line;

F2: an average value of a deviation in the main scanning direction between the different color dots; and G2: a maximum value of a deviation in the main scanning direction between the same color dots; and further comprising the step of setting a precision to establish a tolerance relationship where A2≦B2 and A2≦C2; B2≦D2 and C2≦D2; and at least one of D2≦E2, D2≦F2, and D2≦G2.

24. The method according to claim 23, wherein the tolerance relationship is set to A2≦B2≦C2≦D2≦E2≦F2≦G2.

25. The method according to claim 24, wherein the optical tolerances A2 to G2≦20 μm.

* * * * *